United States Patent [19]

Cliff et al.

[11] Patent Number: 4,813,081

[45] Date of Patent: Mar. 21, 1989

[54] NOVELTY T-SHIRT

[76] Inventors: Kerry D. Cliff, 686 Trailsway La., Neenah, Wis. 54956; Richard A. Warns, 233 S. Lynndale Dr., Appleton, Wis. 54914

[21] Appl. No.: 194,858

[22] Filed: May 17, 1988

[51] Int. Cl.[4] ..... A41D 1/00; A41D 1/18

[52] U.S. Cl. ..... 2/115; 2/244

[58] Field of Search ..... 2/1, 67, 115, 243, 244, 2/246, DIG. 1

[56] References Cited

U.S. PATENT DOCUMENTS

| | | | |
|---|---|---|---|
| 1,149,139 | 8/1915 | Heagle . | |
| 1,799,572 | 4/1931 | Sweeney . | |
| 1,854,821 | 4/1932 | Barker | 2/67 |
| 2,177,543 | 10/1939 | Vecchi | 2/46 |
| 2,242,318 | 5/1941 | Mosier | 2/159 |
| 2,513,210 | 6/1950 | Rosenzweig | 2/90 |
| 2,708,753 | 5/1955 | Kennedy | 2/159 |
| 2,851,805 | 9/1958 | Allen | 41/10 |
| 3,618,139 | 11/1971 | Hugin | 2/115 |
| 4,570,266 | 2/1986 | Schlosser | 2/69 |
| 4,722,099 | 2/1988 | Kratz | 2/79 |

*Primary Examiner*—Werner H. Schroeder
*Assistant Examiner*—Diana L. Biefeld
*Attorney, Agent, or Firm*—John R. Flanagan

[57] ABSTRACT

An article of apparel includes a garment, such as a T-shirt, having a body portion, sleeve portions and an open neck portion. A partially-completed design is placed on the body portion of the garment so as to be externally visible when the garment is worn by a wearer. One or more holes are defined in the body portion of the garment at locations within the perimeters of portions of the partial design which are physically and functionally related to the portions thereof by allowing exposure of the flesh of the wearer through the holes so as to integrate with and complete the design.

16 Claims, 2 Drawing Sheets

NOVELTY T-SHIRT

BACKGROUND OF THE INVENTION

1. Field of the Invention

The present invention generally relates to an article of apparel and, more particularly, is concerned with a novelty-type garment, particularly a T-shirt.

2. Description of the Prior Art

Garments such as T-shirts are popular casual and recreational apparel worn by a broad cross-section of the population. One reason for the wide popularity of these garments are their use of media to carry and exhibit a diverse range of designs being printed or otherwise affixed thereon.

Conventional designs commonly seen on T-shirts range from names and slogans to caricatures of humans, animals and inanimate objects. Sometimes, these designs are color coordinated with the color of the T-shirt. Typically, the design is placed on the body of the T-shirt, either or both front and back, by any one of several methods, for example, silk screening, sewing, printing or thermal bonding.

Without doubt, T-shirts, which carry designs bring much pride, pleasure and enjoyment to their wearers. However, underlying the present invention is the unique perception by the inventors herein that the T-shirt has not yet reached the pinnacle of its utility as a vehicle or medium for artistic expression and enjoyment.

SUMMARY OF THE INVENTION

The present invention provides an article of apparel in the form of a novelty-type garment. Whereas the garment of the present invention is preferably embodied as a T-shirt; other types of garments are equally possible.

The present invention reaches a new plateau in the use of a garment for artistic expression by introducing simple but important modifications which achieve integration or blending of the wearer of the garment with the design printed or affixed on the garment in a unique way not contempated heretofore. Basically, the concept embodied by the combined artistic and utilitarian approach of the present invention is to provide physical features in the garment which will allow or make portion of the flesh of the wearer a major part of the design on the garment.

Particularly, the garment, in effect, has a partial design printed or affixed thereon. The garment also has one or more openings or holes formed in its body within the perimeter of the partial design so as to expose the wearer's skin at the exact place or places in the partial design where exposed skin will complete the design. Thus, there exists a clear, meaningful functional relationship between the partial artistic design on the garment and the physical holes therein which are circumscribed by portions of the design.

In one embodiment, the holes are just empty spaces in the garment. In another embodiment, the holes are bridged by a see-through mesh-like webbing or cloth which will still expose the wearer's skin but which will either add further artistic expression to the design or provide reinforcement in cases where the holes are of large size.

The partial design may be of a human figure with the holes in the garment outlined by some part of the body of the human figure. When the wearer puts on the garment, his or her actual flesh will show through the outer garment holes and appear as part of the design on the garment itself. On the other hand, the partial design may be of a non-human object. However, in either case, the design utilizes the exposed skin of the wearer to complete and enhance its overall artistic meaning and appearance. In some instances, the wearer may choose to wear an undergarment which, as an alternative to the wearer's skin, can serve to complete the design.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
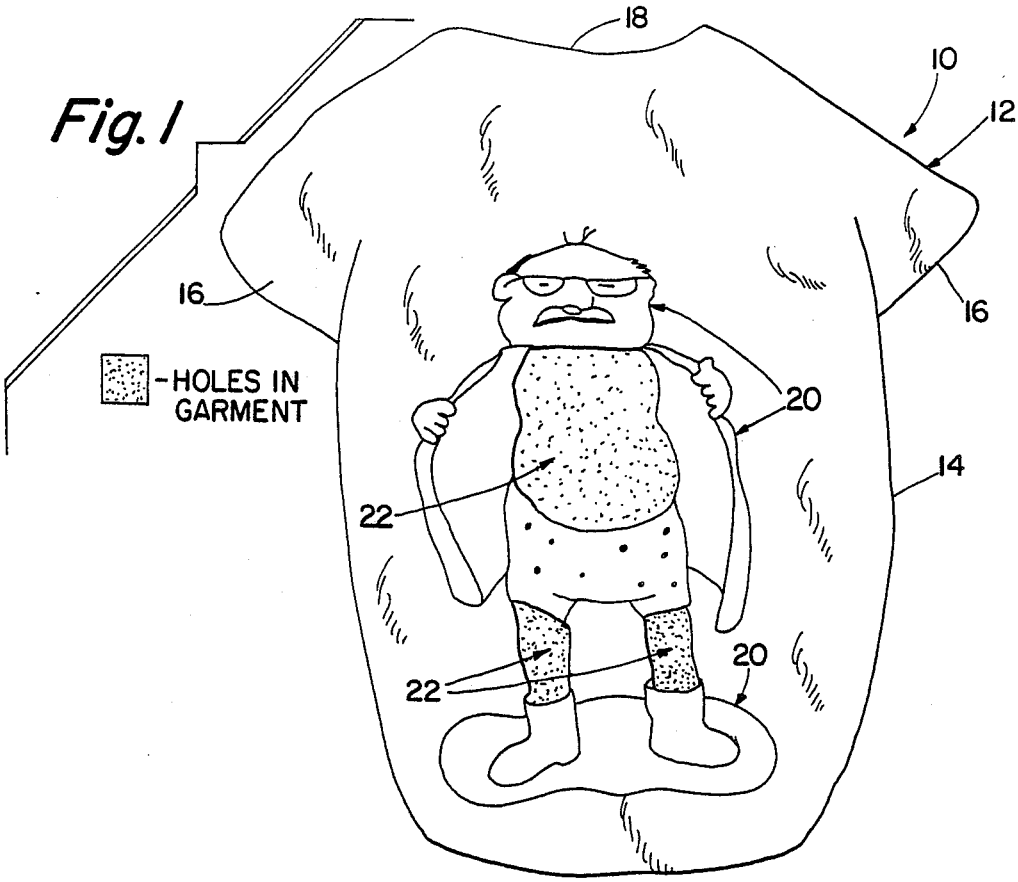
FIG. 1 is a front view of one embodiment of a novelty-type garment constructed in accordance with the concept of the present invention.

Referring now to the drawings, and particularly to FIGS. 1, there is shown an article of apparel, generally designated by the numeral 10, which constitutes one embodiment of the present invention constructed in accordance with the concept of the present invention.

Basically, the article of apparel 10 is a novelty-type garment 12 such as a T-shirt having a body portion 14, sleeve portions 16 and an open neck portion 18. The T-shirt 12 incorporates a partial design 20 placed on the body portion 14 thereof so as to be externally visible when the T-shirt 12 is worn by a wearer. For completing the design 20, at least one and preferably a plurality of holes 22 are defined in the body portion 14 of the T-shirt 12. Uniquely, the holes 22 are located within the perimeter of at least a portion of the design 20.

The partial design 20 shown is a caricature of a male human figure with the holes 22 in the T-shirt 12 outlined by the portions of the legs, stomach and chest of the human figure. Thus, when the wearer puts on the T-shirt 12, his or her actual flesh will show through the holes 22 in the T-shirt 12 within the perimeter of these portions of the partial design 20 and appear as part of the design on the T-shirt. In such manner, the holes 22 and their locations are physically and functionally related to the content of the design by allowing exposure of a portion of the wearer through the holes which will integrate with and complete the design.

Figure 2:
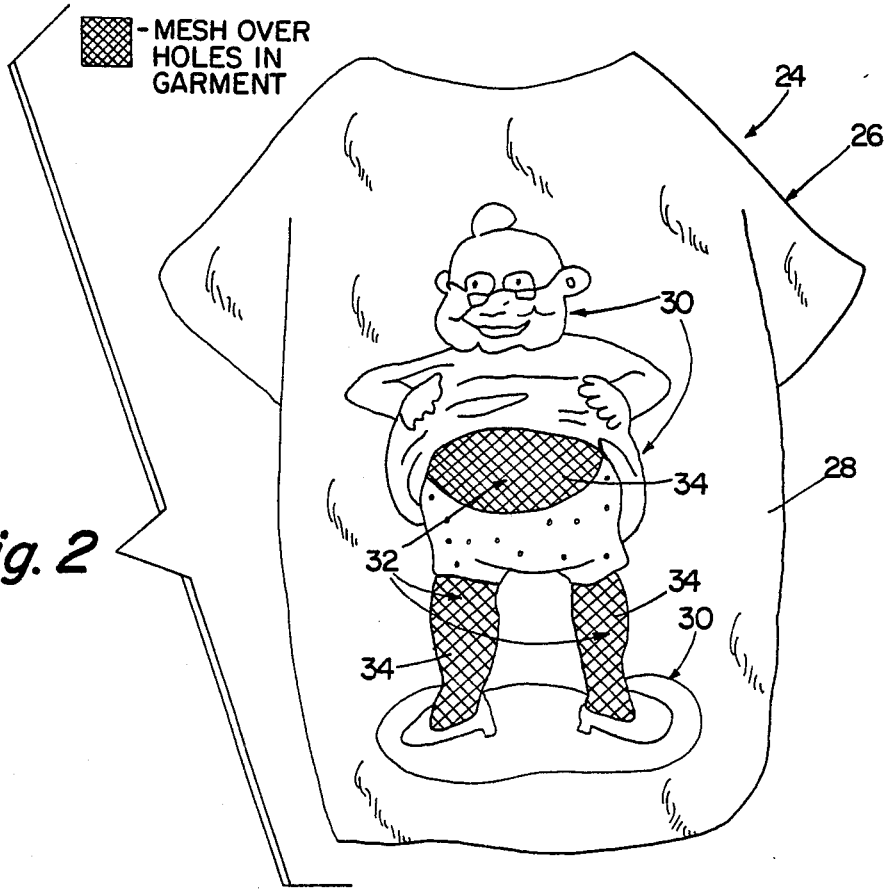
FIG. 2 is a front view of another embodiment of the novelty-type garment of the present invention.

FIG. 2 shows another embodiment of an article of apparel 24 of the present invention. Again, the apparel article 24 is in the form of a T-shirt 26 having on its body portion 28 a partial design 30 of a caricature of a female human figure. Holes 32 are defined in the body portion 28 within the perimeter of the partial design 30 at the locations of portions of the legs and stomach of the human figure. In this embodiment, the holes 32 in the T-shirt are overlaid by a see-through mesh-like material 34 which still allows exposure of the wearer's skin therethrough.

Figure 3:
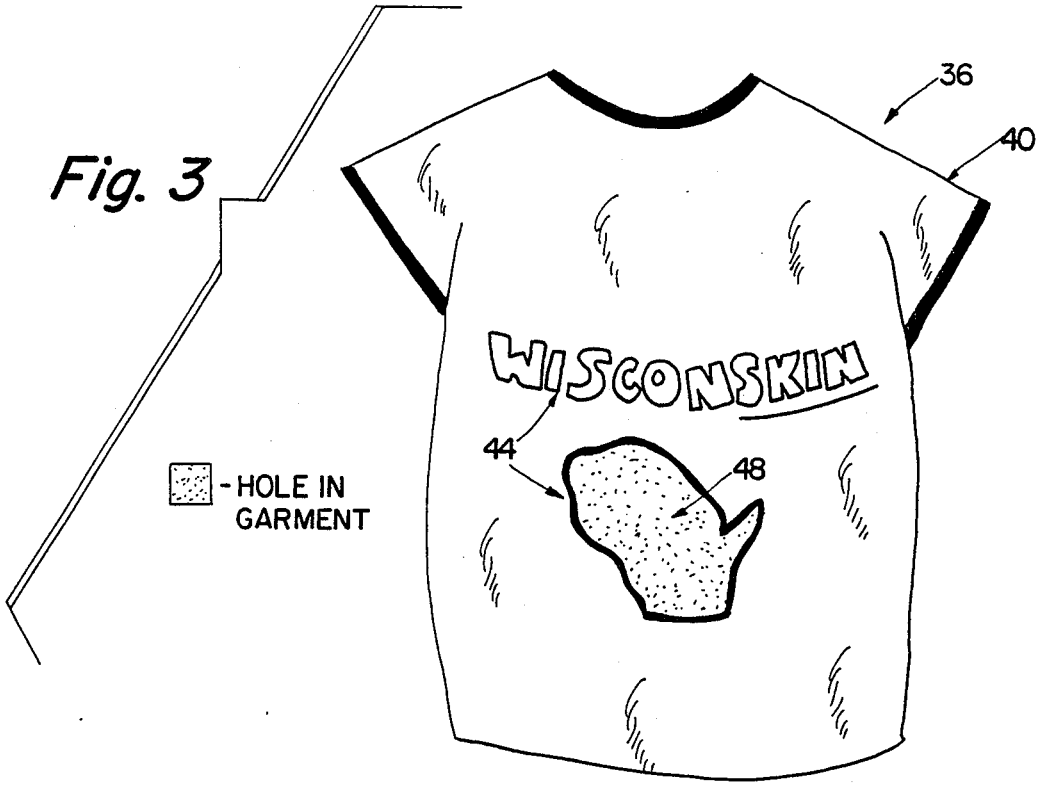
FIG. 3 is a front view of still another embodiment of the novelty-type garment of the present invention.
Figure 4:
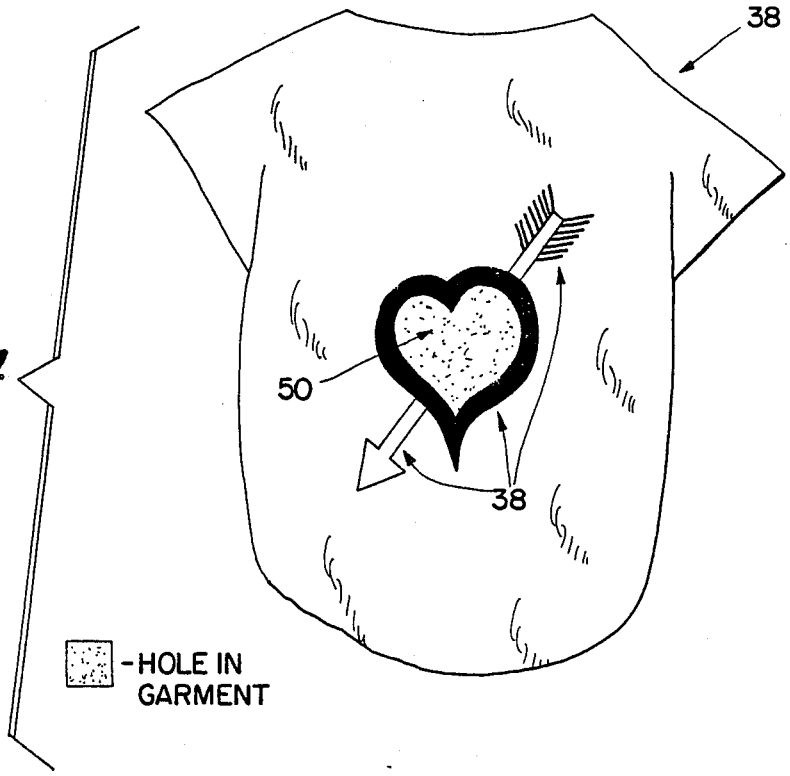
FIG. 4 is a front view of yet another embodiment of the novelty-type garment of the present invention.

FIGS. 3 and 4 respectively illustrate other embodiments of articles of apparel, 36, 38 of the present invention. These apparel articles 36, 38 are also in the form of T-shirts 40, 42 with a partial designs 44, 46 thereon. However, in these embodiments, the partial designs 44, 46 are of non-human objects. As with the previous partial designs 20, 30 of the human figures, the wearer's flesh is exposed through respective hole 48, 50 in the T-shirts 40, 42 encircled by the perimeter of the non-human partial designs and integrates with and completes the designs. In the same manner as above, the holes 48, 50 and their locations are physically and functionally related to the content of the partial designs 44, 46 by allowing exposure of a portion of the wearer through the holes so as to complete the designs.

In FIG. 3, the partial design 44 encompassing the hole 48 is an outline of the State of Wisconsin. The word "WISCONSIN" is a parody of the name of the state for identifying the skin of the wearer of the T-shirt 40 appearing in the hole 48 within the partial design 44. In FIG. 4, the partial design 46 encompassing the hole 50 is an outline of a heart. So when the skin of the wearer of the T-shirt 42 appears in the hole 50, the design takes on the appearance of a human heart.

Although the garments illustrated herein which embody the present invention are all T-shirts, it should be understood that the concept of the present invention applies to other types of garments, such as pants and shirts of all types. Also, it should be understood that sleeve and neck portions of the shirt mean those portions of any shirt through which the wearer has to extend his or her arms and neck in order to put the shirt on. Therefore, under such meaning, sleeve and neck portions are also present in shirts commonly known as sleeveless and neckless types.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the forms hereinbefore described being merely preferred or exemplary embodiments thereof.

Having thus described the invention, what is claimed is:

1. An article of apparel, comprising:

(a) a garment;

(b) a partial design of a caricature of an object placed on said garment so as to be externally visible when said garment is worn by a wearer, said partial design having a perimeter and a predetermined graphic content; and (c) means defining at least one hole in said garment of a given configuration and being located within said perimeter of at least a portion of said partial design and physically and functionally related thereto by allowing exposure of a portion of the wearer through said hole which integrates with and completes said graphic content of said partial design;

(d) said graphic content of said partial design being physically separate from the configuration of said hole in said garment.

2. The article of apparel of claim 1 wherein said partial design is a caricature of a human figure.

3. The article of apparel of claim 2 wherein said portions of said partial design in which said hole is defined is the torso of said human figure.

4. The article of apparel of claim 2 wherein a plurality of said holes are defined in said garment in said portions of said partial design on said garment, said partial design portions being legs of said human figure.

5. The article of apparel of claim 1 wherein said hole in said garment within said partial design is bridged by a seethrough mesh-like material.

6. The article of apparel of claim 1 wherein said partial design is a caricature of a non-human object.

7. An article of apparel, comprising:

(a) a garment having a body portion, sleeve portions and an open neck portion;

(b) a partially-completed design of a caricature of an object placed on said body portion of said garment so as to be externally visible when said garment is worn by a wearer, said partial design having a perimeter and a predetermined graphic content; and (c) means defining at least one hole in said body portion of said garment, said hole being of a given configuration and located within said perimeter of at least a portion of said partial design and physically and functionally related thereto by allowing exposure of a portion of the wearer through said hole which integrates with and completes said graphic content of said partial design;

(d) said graphic content of said partial design being physically separate from the configuration of said hole in said garment.

8. The article of apparel of claim 7 wherein said partial design is a representation of a human figure.

9. The article of apparel of claim 8 wherein said portions of said partial design in which said hole is defined in the torso of said human figure.

10. The article of apparel of claim 8 wherein a plurality of said holes are defined in said garment in said portions of said partial design on said garment, said partial design portions being legs of said human figure.

11. The article of apparel of claim 7 wherein said hole in said garment within said partial design is bridged by a seethrough mesh-like material.

12. The article of apparel of claim 7 wherein said partial design is a representation of a non-human object.

13. A novelty-type garment, comprising:

(a) a T-shirt having a body portion, sleeve portions and an open neck portion;

(b) a partially-completed design of a caricature of an object placed on said body portion of said T-shirt so as to be externally visible when said T-shirt is worn by a wearer, said partial design having a perimeter and a predetermined graphic contect; and (c) means defining at least one hole in said body portion of said garment, said hole being of a given configuration and located within said perimeter of at least a portion of said partial design and physically and functionally related thereto by allowing exposure of a portion of the wearer through said hole which integrates with and completes said graphic content of said partial design;

(d) said graphic content of said partial design being physically separate from the configuration of said hole in said garment.

14. The article of apparel of claim 13 wherein said partial design is a representation of a human figure.

15. The article of apparel of claim 13 wherein said hole in said garment within said partial design is bridged by a see-through mesh-like material.

16. The article of apparel of claim 13 wherein said partial design is a presentation of a non-human object

* * * * *

UNITED STATES PATENT AND TRADEMARK OFFICE

CERTIFICATE OF CORRECTION

PATENT NO. : 4,813,081

DATED : March 21, 1989

INVENTOR(S) : Kerry D. Cliff et al

It is certified that error appears in the above-identified patent and that said Letters Patent is hereby corrected as shown below:

Column 4, line 51 (Claim 13, line 8), "contect" should be -- content --.

Column 4, line 67 (Claim 16, line 2), after "object" insert a period -- . --.

Signed and Sealed this

Sixth Day of November, 1990

*Attest:*

HARRY F. MANBECK, JR.

*Attesting Officer*

*Commissioner of Patents and Trademarks*